US011008636B2

(12) United States Patent
Mizutani et al.

(10) Patent No.: US 11,008,636 B2
(45) Date of Patent: May 18, 2021

(54) STAINLESS STEEL SHEET AND STAINLESS STEEL FOIL

(71) Applicant: JFE STEEL CORPORATION, Tokyo (JP)

(72) Inventors: Akito Mizutani, Tokyo (JP); Mitsuyuki Fujisawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 33 days.

(21) Appl. No.: 16/342,313

(22) PCT Filed: Oct. 16, 2017

(86) PCT No.: PCT/JP2017/037329
§ 371 (c)(1),
(2) Date: Apr. 16, 2019

(87) PCT Pub. No.: WO2018/074405
PCT Pub. Date: Apr. 26, 2018

(65) Prior Publication Data

US 2019/0249269 A1 Aug. 15, 2019

(30) Foreign Application Priority Data

Oct. 17, 2016 (JP) ..... JP2016-203558

(51) Int. Cl.

| | |
|---|---|
| ***B21C 37/00*** | (2006.01) |
| ***C21D 9/46*** | (2006.01) |
| ***C22C 38/50*** | (2006.01) |
| ***C22C 38/48*** | (2006.01) |
| ***C22C 38/46*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/02*** | (2006.01) |
| ***C21D 6/00*** | (2006.01) |
| ***F01N 3/28*** | (2006.01) |
| ***C22C 38/54*** | (2006.01) |
| ***F01N 13/00*** | (2010.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0236* (2013.01); *C21D 8/0263* (2013.01); *C21D 8/0268* (2013.01); *C21D 8/0273* (2013.01); *C22C 38/001* (2013.01); *C22C 38/002* (2013.01); *C22C 38/004* (2013.01); *C22C 38/005* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *F01N 3/2807* (2013.01); *F01N 13/008* (2013.01); *F01N 2330/02* (2013.01); *F01N 2560/025* (2013.01); *F01N 2590/04* (2013.01); *Y10T 428/12431* (2015.01)

(58) Field of Classification Search
None
See application file for complete search history.

(56) References Cited

U.S. PATENT DOCUMENTS

| | | | | |
|---|---|---|---|---|
| 5,626,694 | A * | 5/1997 | Kawabata | C21D 8/0205 148/609 |
| 5,665,669 | A | 9/1997 | Yamanaka et al. | |
| 6,086,689 | A * | 7/2000 | Sassoulas | C21D 8/0205 148/531 |
| 2014/0219855 | A1 | 8/2014 | Hattendorf et al. | |
| 2014/0287914 | A1 | 9/2014 | Mizutani et al. | |
| 2015/0218683 | A1 | 8/2015 | Nakamura et al. | |
| 2015/0299833 | A1 | 10/2015 | Mizutani et al. | |
| 2016/0160328 | A1 | 6/2016 | Mizutani et al. | |

FOREIGN PATENT DOCUMENTS

| | | | |
|---|---|---|---|
| CN | 104093872 | A | 10/2014 |
| EP | 2 723 910 | A1 | 4/2014 |
| EP | 2811044 | A1 | 12/2014 |
| EP | 2 902 523 | A1 | 8/2015 |
| EP | 3130688 | A1 | 2/2017 |
| JP | S64-56822 | A | 3/1989 |
| JP | H05-277380 | A | 10/1993 |

(Continued)

OTHER PUBLICATIONS

Jan. 9, 2018 Search Report issued in International Patent Application No. PCT/JP2017/037329.

(Continued)

*Primary Examiner* — Seth Dumbris
(74) *Attorney, Agent, or Firm* — Oliff PLC

(57) ABSTRACT

A stainless steel foil having a chemical composition comprising, by mass %, C: 0.015% or less, Si: 0.50% or less, Mn: 0.50% or less, P: 0.040% or less, S: 0.010% or less, Cr: 10.0% or more and less than 16.0%, Al: 2.5 to 4.5%, N: 0.015% or less, Ni: 0.05 to 0.50%, Cu: 0.01 to 0.10%, Mo: 0.01 to 0.15%, at least one selected from the group consisting of Ti: 0.01 to 0.30%, Zr: 0.01 to 0.20%, Hf: 0.01 to 0.20%, and REM: 0.01 to 0.20%, where Ti+Zr+Hf+2REM≥0.06 and 0.30≥Ti+Zr+Hf are satisfied.

6 Claims, No Drawings

(56) References Cited

FOREIGN PATENT DOCUMENTS

| | | | |
|---|---|---|---|
| JP | H11-335789 | A | 12/1999 |
| JP | 2003-112235 | A | 4/2003 |
| JP | 2011-032524 | A | 2/2011 |
| JP | 2013-155435 | A | 8/2013 |
| JP | 5561447 | B1 | 7/2014 |
| JP | 2014-523967 | A | 9/2014 |
| JP | 2016-102231 | A | 6/2016 |
| WO | 2014/050016 | A1 | 4/2014 |
| WO | 2014/097562 | A1 | 6/2014 |
| WO | 2015/015728 | A1 | 2/2015 |
| WO | 2015/155920 | A1 | 10/2015 |

OTHER PUBLICATIONS

Jul. 3, 2020 Office Action issued in Chinese Patent Application No. 201780063847.6.

Sep. 6, 2019 Extended Search Report issued in European Patent Application No. 17861347.7.

Sep. 4, 2020 Office Action issued in Korean Patent Application No. 10-2019-7010858.

Mar. 9, 2021 Office Action issued in European Application No. 17 861 347.7.

Bernstein, I.M. et al. "Residual and Minor Elements in Stainless Steel", Handbook of Stainless Steels, XP002430954, pp. (14-1)-(14-13), Jan. 1977.

* cited by examiner

STAINLESS STEEL SHEET AND STAINLESS STEEL FOIL

TECHNICAL FIELD

This application relates to a stainless steel sheet and a stainless steel foil having good manufacturability in addition to excellent high-temperature oxidation resistance and high-temperature shape stability.

BACKGROUND

Because of the excellent high-temperature oxidation resistance, Fe—Cr—Al-type stainless steel is processed into stainless steel foil and used for catalyst carriers (metal honeycombs) of exhaust emission control devices in automobiles, motorcycles, jet skis, motorboats, large lawnmowers, small generators, and so forth.

Such a metal honeycomb has a honeycomb structure composed of, for example, alternately stacked flat stainless steel foils (flat foils) and corrugated stainless steel foils (corrugated foils), where the foils are fixed together by brazing or the like. Further, the surface of such stainless steel foils are coated with a catalyst substance and used for an exhaust emission control device.

Stainless steel foils for metal honeycombs are required, for example, to have an unchanged shape even in high-temperature use, in addition to excellent high-temperature oxidation resistance. This is because deformation causes peeling off of catalyst layers and/or impeded exhaust gas flow due to flattened honeycomb pores.

Meanwhile, Fe—Cr—Al-type stainless steel has toughness of the intermediate materials (a hot-rolled steel sheet, a cold-rolled steel sheet, and the like) in foil manufacture inferior to other stainless steels. For this reason, Fe—Cr—Al-type stainless steel is a type of steel that is difficult to manufacture and is a type of steel in which stopped operation and/or a considerably low yield result from frequent sheet fracture during annealing or descaling of a hot-rolled steel sheet or during cold rolling.

As a means to improve the toughness of hot-rolled steel sheets and/or cold-rolled steel sheets of Fe—Cr—Al-type stainless steel, Patent Literature 1 and Patent Literature 2, for example, disclose a technique of improving toughness through stabilizing impurity elements in steel, such as C and N, by containing Ti and/or Nb. Further, the present inventors disclosed in Patent Literature 3 that a stainless steel sheet having excellent toughness is obtained by combined containing of V and B in specific ranges.

CITATION LIST

Patent Literature

PTL 1: Japanese Unexamined Patent Application Publication No. 64-56822

PTL 2: Japanese Unexamined Patent Application Publication No. 5-277380

PTL 3: Japanese Patent No. 5561447 (International Publication No. 2014/097562)

SUMMARY

Technical Problem

In accordance with the enhanced quietness and environmental performance of diesel engines, the proportion of passenger cars equipped with diesel engines has been increasing in recent years. The temperature reached by exhaust gases in these cars is about 800° C. to 900° C., which is lower than that in gasoline cars of 1000° C. or higher. Accordingly, stainless steel foil used for metal honeycombs of diesel cars is not required to have oxidation resistance as high as that for gasoline cars. Consequently, there is a need for a stainless steel foil that has oxidation resistance decreased to a level corresponding to that of diesel cars and improved economic efficiency.

Decreasing cold rolling costs is effective for decreasing costs of foil materials that are prepared through many cold rolling processes. Specifically, it is effective to partially replace cold rolling processes for foils from conventional reverse rolling to more productive continuous tandem rolling. Such replacement improves productivity of rolling processes and makes it possible to reduce manufacturing costs. It was difficult, however, to manufacture the stainless steels disclosed in Patent Literature 1 to 3 in a continuous tandem rolling mill due to their low toughness. To improve toughness in the present composition system, decreasing Cr content and/or Al content is effective. This causes, however, a problem in which high-temperature oxidation resistance and/or shape stability during high-temperature use of final products deteriorate.

An object of the disclosed embodiments is to obtain a stainless steel sheet having improved manufacturability by achieving good toughness and to obtain, by using such a steel sheet, an Fe—Cr—Al-type stainless steel foil that is used in an environment at an exhaust gas temperature of about 900° C. without deterioration in high-temperature oxidation resistance or shape stability during high-temperature use.

Solution to Problem

The present inventors conducted intensive research to achieve the above-mentioned objects and found that the toughness of Fe—Cr—Al-type stainless steel is improved by decreasing Cr content compared with a conventional one, and consequently, that continuous tandem rolling can be performed in a stable manner. Further, it was found that high-temperature oxidation resistance and shape stability during high-temperature use can be ensured despite decreased Cr content compared with the conventional one by including an appropriate amount of Mo.

The disclosed embodiments have been made on the basis of such findings and will be summarized as follows.

[1] A stainless steel sheet containing, in mass %, C: 0.015% or less, Si: 0.50% or less, Mn: 0.50% or less, P: 0.040% or less, S: 0.010% or less, Cr: 10.0% or more and less than 16.0%, Al: 2.5 to 4.5%, N: 0.015% or less, Ni: 0.05 to 0.50%, Cu: 0.01 to 0.10%, Mo: 0.01 to 0.15%, and further containing at least one of Ti: 0.01 to 0.30%, Zr: 0.01 to 0.20%, Hf: 0.01 to 0.20%, and REM: 0.01 to 0.20% so as to satisfy the following Expression (1) and Expression (2), with the balance being Fe and incidental impurities:

$$Ti+Zr+Hf+2REM \geq 0.06 \quad \text{Expression (1)}$$

$$0.30 \geq Ti+Zr+Hf \quad \text{Expression (2)}$$

where Ti, Zr, Hf, and REM of Expression (1) and Expression (2) each represent the content (mass %) of each respective element and are set to zero if not contained.

[2] The stainless steel sheet according to [1], further containing, in mass %, at least one of Nb: 0.01 to 0.10%, V: 0.01 to 0.50%, B: 0.0003 to 0.0100%, Ca: 0.0002 to 0.0100%, and Mg: 0.0002 to 0.0100%.

[3] A stainless steel foil having the component composition according to [1] or [2] and a thickness of 200 μm or less.

[4] The stainless steel foil according to [3], where the stainless steel foil is used for a catalyst carrier of an exhaust emission control device.

Advantageous Effects

According to the disclosed embodiments, a stainless steel sheet having improved manufacturability by achieving good toughness can be obtained. Moreover, by using a stainless steel sheet of the disclosed embodiments, an Fe—Cr—Al-type stainless steel foil that is used in an environment at an exhaust gas temperature of about 900° C. can be obtained without deterioration in high-temperature oxidation resistance or shape stability during high-temperature use.

DETAILED DESCRIPTION

Hereinafter, the disclosed embodiments will be described. The disclosure, however, is not intended to be limited to the following specific embodiments.

First, the component composition of a stainless steel sheet of the disclosed embodiments will be described in detail. The stainless steel sheet of the disclosed embodiments is a hot-rolled sheet (hot-rolled steel sheet) and/or a cold-rolled sheet (cold-rolled steel sheet) and has excellent toughness. Moreover, a stainless steel foil manufactured by using a stainless steel sheet of the disclosed embodiments exhibits satisfactory oxidation resistance and is difficult to deform even in use at a high temperature. The reasons for limiting the component composition of a stainless steel sheet are as follows.

The unit "%" denoting the respective content of each of the component elements below means mass %.

C: 0.015% or less

When C content exceeds 0.015%, the manufacture of stainless steel sheets becomes difficult due to deterioration in toughness of hot-rolled steel sheets and/or cold-rolled steel sheets. Accordingly, C content is set to 0.015% or less, preferably 0.010% or less, and more preferably 0.008% or less. C content may be 0%, but an extremely low C content requires prolonged time for refinement, thereby making the manufacture difficult. Accordingly, C content is set to preferably 0.002% or more, more preferably 0.004% or more, and further preferably 0.005% or more.

Si: 0.50% or less

When Si content exceeds 0.50%, the manufacture of stainless steel sheets becomes difficult due to deterioration in toughness of hot-rolled steel sheets and/or cold-rolled steel sheets. Accordingly, Si content is set to 0.50% or less, preferably 0.30% or less, and more preferably 0.20% or less. However, attempting to achieve Si content of less than 0.01% makes refinement difficult. Accordingly, Si content is preferably 0.01% or more, more preferably 0.08% or more, and further preferably 0.11% or more.

Mn: 0.50% or less

When Mn content exceeds 0.50%, oxidation resistance of steel deteriorates. Accordingly, Mn content is set to 0.50% or less, preferably 0.30% or less, and more preferably 0.15% or less. However, attempting to achieve Mn content of less than 0.01% makes refinement difficult. Accordingly, Mn content is preferably 0.01% or more, more preferably 0.05% or more, and further preferably 0.10% or more.

P: 0.040% or less

When P content exceeds 0.040%, the manufacture of stainless steel sheets becomes difficult due to deterioration in toughness and impaired ductility of steel. Accordingly, P content is set to 0.040% or less and preferably 0.030% or less, and more preferably, P content is decreased as much as possible. Meanwhile, an excessive decrease in P content results in increased manufacturing costs. To suppress an increase in manufacturing costs, the lower limit of P content is preferably 0.005%.

S: 0.010% or less

When S content exceeds 0.010%, the manufacture of hot-rolled steel sheets becomes difficult due to deterioration in hot workability. Accordingly, S content is set to 0.010% or less, preferably 0.006% or less, and more preferably 0.004% or less. Meanwhile, an excessive decrease in S content results in increased manufacturing costs. To suppress an increase in manufacturing costs, the lower limit of S content is preferably 0.001%.

Cr: 10.0% or more and less than 16.0%

Cr is an essential element for ensuring high-temperature oxidation resistance. When Cr content is less than 10.0%, satisfactory oxidation resistance cannot be ensured. Meanwhile, when Cr content reaches 16.0% or more, the manufacture in a continuous tandem rolling mill becomes difficult due to deterioration in toughness of hot-rolled sheets and/or cold-rolled sheets. Accordingly, Cr content is set to 10.0% or more and less than 16.0%. The lower limit is preferably 11.0% or more and more preferably 12.0% or more. The upper limit is preferably 15.0% or less, more preferably 14.0% or less, further preferably less than 13%, and still further preferably 12.5% or less.

Al: 2.5 to 4.5%

Al is an element that improves oxidation resistance by forming an oxide layer containing $Al_2O_3$ as a main component during high-temperature oxidation. Such an effect is obtained when Al content is 2.5% or more. Meanwhile, when Al content exceeds 4.5%, the manufacture in a continuous tandem rolling mill becomes difficult due to deterioration in toughness of hot-rolled sheets and/or cold-rolled sheets. Accordingly, Al content is 2.5 to 4.5%. The lower limit is preferably 3.0% or more and more preferably 3.2% or more. The upper limit is preferably 4.0% or less and more preferably 3.8% or less.

N: 0.015% or less

When N content exceeds 0.015%, the manufacture of stainless steel becomes difficult due to deterioration in toughness of steel. Accordingly, N content is set to 0.015% or less, preferably 0.010% or less, and more preferably 0.008% or less. N content may be 0%, but an extremely low content requires prolonged time for refinement, thereby making the manufacture difficult. Accordingly, N content is set to preferably 0.002% or more and more preferably 0.005% or more.

Ni: 0.05 to 0.50%

Ni effectively improves brazability while forming into a catalyst carrier. Accordingly, Ni content is set to 0.05% or more. Ni is, however, an austenite-forming element. When the content exceeds 0.50%, an austenite phase is formed after Al in foil is consumed with progression of high-temperature oxidation. Such an austenite phase increases the thermal expansion coefficient of the foil and thus causes foil defects, such as constriction and fracture. Accordingly, Ni content is set to 0.05% to 0.50%. The lower limit is preferably 0.10% or more and more preferably 0.13% or more. The upper limit is preferably 0.20% or less and more preferably 0.17% or less.

Cu: 0.01 to 0.10%

Cu effectively improves high-temperature strength through precipitation in steel. Such an effect is obtained by containing Cu at 0.01% or more. Meanwhile, a content exceeding 0.10% results in deterioration in toughness of steel. Accordingly, Cu content is set to 0.01 to 0.10%. The lower limit is preferably 0.02% or more and more preferably 0.03% or more. The upper limit is preferably 0.07% or less and more preferably 0.05%.

Mo: 0.01 to 0.15%

Mo effectively improves shape stability during high-temperature use. Such an effect is obtained by containing Mo at 0.01% or more. Meanwhile, a content exceeding 0.15% results in deterioration in toughness, thereby making the manufacture in a continuous tandem rolling mill difficult. Accordingly, Mo content is set to 0.01 to 0.15%. The lower limit is preferably 0.02% or more and more preferably 0.04% or more. The upper limit is preferably 0.10% or less and more preferably 0.06% or less.

In addition to the above-described components, a stainless steel sheet of the disclosed embodiments further contains at least one of Ti: 0.01 to 0.30%, Zr: 0.01 to 0.20%, Hf: 0.01 to 0.20%, and REM: 0.01 to 0.20%.

An $Al_2O_3$ oxide layer formed on an Fe—Cr—Al-type stainless steel foil that lacks these components has poor adhesion to substrate iron. As a result, the $Al_2O_3$ oxide layer spalls off each time the temperature changes from high to low during use, and consequently, good oxidation resistance cannot be achieved. Ti, Zr, Hf, or REM effectively improves adhesion and suppresses spalling of the $Al_2O_3$ oxide layer, thereby increasing oxidation resistance.

Ti: 0.01 to 0.30%

Ti improves adhesion of an $Al_2O_3$ oxide layer, thereby improving oxidation resistance. In addition, Ti improves the toughness of hot-rolled sheets and/or cold-rolled sheets by stabilizing C and N. Such effects are obtained at a Ti content of 0.01% or more. Meanwhile, when Ti content exceeds 0.30%, a large amount of Ti oxide is mixed into the $Al_2O_3$ oxide layer, thereby increasing the growth rate of the oxide layer and deteriorating oxidation resistance. Accordingly, Ti content is set to 0.01 to 0.30%. The lower limit is preferably 0.10% or more and more preferably 0.12% or more. The upper limit is preferably 0.20% or less and more preferably 0.18% or less.

Zr: 0.01 to 0.20%

Zr improves adhesion of an $Al_2O_3$ oxide layer and decreases the growth rate thereof, thereby improving oxidation resistance. In addition, Zr improving toughness by stabilizing C and N. Such effects are obtained at a Zr content of 0.01% or more. Meanwhile, when Zr content exceeds 0.20%, a large amount of Zr oxide is mixed into the $Al_2O_3$ oxide layer, thereby increasing the growth rate of the oxide layer and deteriorating oxidation resistance. Moreover, Zr forms an intermetallic compound with Fe and the like, thereby deteriorating toughness. Accordingly, Zr content is set to 0.01 to 0.20%. The lower limit is preferably 0.02% or more, and the upper limit is preferably 0.10% or less and more preferably 0.05% or less.

Hf: 0.01 to 0.20%

Hf improves adhesion to steel of an $Al_2O_3$ oxide layer and decreases the growth rate thereof, thereby improving oxidation resistance. Such an effect is obtained at a Hf content of 0.01% or more. Meanwhile, when Hf content exceeds 0.20%, a large amount of Hf oxide is mixed into the $Al_2O_3$ oxide layer, thereby increasing the growth rate of the oxide layer and deteriorating oxidation resistance. Moreover, Hf forms an intermetallic compound with Fe and the like, thereby deteriorating toughness. Accordingly, Hf content is set to 0.01 to 0.20%. The lower limit is preferably 0.02% or more, and the upper limit is preferably 0.10% or less and more preferably 0.05% or less.

REM (rare earth metals): 0.01 to 0.20%

REM refers to Sc, Y, and lanthanides (elements of atomic number 57 to 71, such as La, Ce, Pr, Nd, and Sm). REM improves adhesion of an $Al_2O_3$ oxide layer and exerts an extremely remarkable effect of improving spalling resistance of the $Al_2O_3$ oxide layer in an environment that is subjected to cyclic oxidation. Accordingly, REM is particularly preferably contained when excellent oxidation resistance is required. Such an effect is obtained by containing REM at 0.01% in total. Meanwhile, when REM content exceeds 0.20%, the manufacture of hot-rolled steel sheets becomes difficult due to the deterioration of hot workability. Accordingly, REM content is set to 0.01 to 0.20%. The lower limit is preferably 0.03% or more and more preferably 0.05% or more. The upper limit is preferably 0.15% or less, more preferably 0.10% or less, and further preferably 0.08% or less. Here, REM may be added as an unseparated, unpurified metal (misch metal, for example) thereof to decrease costs.

$$Ti+Zr+Hf+2REM \geq 0.06 \quad (1)$$

As in the foregoing, in the disclosed embodiments, at least one of Ti, Zr, Hf, and REM is contained in a predetermined content range to improve oxidation resistance. The present inventors further found, as a result of intensive research, that oxidation resistance deteriorates and that desired shape stability during high-temperature use cannot be obtained when Ti+Zr+Hf+2REM (sum of Ti, Zr, and Hf contents and two-fold REM content) is less than 0.06%. Accordingly, in the disclosed embodiments, Ti+Zr+Hf+2REM is set to 0.06% or more and more preferably 0.10% or more, in addition to setting Ti content, Zr content, Hf content, and REM content to the above-described respective ranges. The upper limit is not particularly limited, but is preferably 0.60% or less and more preferably 0.35% or less. In Expression (1), Ti, Zr, Hf, and REM represent the content (mass %) of each respective element.

$$0.30 \geq Ti+Zr+Hf \quad (2)$$

Excessive Ti, Zr, and Hf contents result in an increased oxidation rate and deterioration in shape stability during high-temperature use. Accordingly, Ti+Zr+Hf (sum of Ti content, Zr content, and Hf content) is set to 0.30% or less, preferably 0.25% or less, and more preferably 0.20% or less, in addition to setting Ti content, Zr content, and Hf content to the above-described respective ranges. In Expression (2), Ti, Zr, and Hf represent the content (mass %) of each respective element.

A stainless steel sheet of the disclosed embodiments preferably further contains at least one selected from Nb, V, B, Ca, and Mg in a predetermined amount, in addition to the above-described components.

Nb: 0.01 to 0.10%

Nb stabilizes C and N, thereby improves toughness. Such an effect is obtained at a Nb content of 0.01% or more. Meanwhile, when Nb content exceeds 0.10%, a large amount of Nb oxide is incorporated into an $Al_2O_3$ oxide layer, thereby increasing the growth rate of the oxide film and deteriorating oxidation resistance. Accordingly, Nb content is set to 0.01 to 0.10%. The lower limit is preferably 0.02% or more and more preferably 0.04% or more. The upper limit is preferably 0.07% or less and more preferably 0.05% or less.

V: 0.01 to 0.50%

V is combined with C and N contained in steel, thereby improving toughness. Such an effect is obtained at a V content of 0.01% or more. Meanwhile, when V content exceeds 0.50%, oxidation resistance deteriorates in some cases. Accordingly, when V is contained, V content is set to the range of 0.01 to 0.50%. The lower limit is preferably 0.03% or more and more preferably 0.05% or more. The upper limit is preferably 0.40% or less and more preferably 0.10% or less.

B: 0.0003 to 0.0100%

B in an appropriate amount is an element that effectively improves oxidation resistance. Such an effect is obtained at a B content of 0.0003% or more. Meanwhile, when B content exceeds 0.0100%, toughness deteriorates. Accordingly, B content is set to the range of 0.0003 to 0.0100%. The lower limit is preferably 0.0005% or more and more preferably 0.0008% or more. The upper limit is preferably 0.0030% or less and more preferably 0.0015% or less.

Ca: 0.0002 to 0.0100%, Mg: 0.0002 to 0.0100%

An appropriate amount of Ca or Mg improves adhesion of an $Al_2O_3$ oxide layer to steel and decreases the growth rate thereof, thereby improving oxidation resistance. Such an effect is obtained at a Ca content of 0.0002% or more and at a Mg content of 0.0002% or more. More preferably, Ca content is 0.0010% or more and Mg content is 0.0015% or more. Meanwhile, excessive addition of these elements deteriorates toughness and/or oxidation resistance. Accordingly, Ca and Mg are each contained at preferably 0.0100% or less and more preferably 0.0050% or less.

The balance other than the above-described components is Fe and incidental impurities. Examples of incidental impurities include Co, Zn, and Sn, and the content of each of these elements is preferably 0.3% or less. When an optional component with the lower limit described above, among the above-described components, is contained at less than the lower limit, such an optional component is deemed to be contained as an incidental impurity.

Next, a preferable manufacturing method will be described. Such a manufacturing method is not particularly limited, and an exemplary method includes: refining steel having the above-described component composition in a converter and/or an electric furnace; further refining through VOD (vacuum oxygen decarburization), AOD (argon oxygen decarburization), or the like, followed by slabbing and rolling or continuous casting into a slab; heating the slab to 1,050° C. to 1,250° C.; and hot rolling. Subsequently, a hot-rolled sheet obtained by this method is preferably subjected to continuous annealing at a temperature of 850° C. to 1,050° C. as necessary, followed by descaling through pickling, polishing, or the like. In pickling, sulfuric acid or a mixed solution of nitric acid and hydrofluoric acid, for example, may be used. As necessary, scale may be removed by shot blasting before pickling.

A cold-rolled steel sheet is manufactured by repeating annealing and cold rolling of such a hot-rolled steel sheet as necessary. Cold rolling in this case may be performed once or two or more times via intermediate annealing in view of productivity and/or surface quality. Such cold rolling can be performed in a continuous tandem rolling mill to increase productivity. Intermediate annealing is performed at a temperature of preferably 850° C. to 1,000° C. and more preferably 900° C. to 950° C. The resulting cold-rolled sheet may be subjected to: as necessary, continuous annealing at a temperature of 850° C. to 1,050° C., followed by descaling through pickling, polishing, or the like; or bright annealing at a temperature of 850° C. to 1,050° C.

Now, stainless steel foil will be described. A stainless steel foil of the disclosed embodiments is manufactured to a desired thickness by further cold rolling of the above-described stainless steel cold-rolled sheet (as cold-rolled material, cold-rolled annealed material, cold-rolled annealed and descaled material). Cold rolling in this case may be performed once or two or more times via intermediate annealing in view of productivity and/or surface quality. Intermediate annealing is performed at a temperature of preferably 800° C. to 1,000° C. and more preferably 850° C. to 950° C. The resulting stainless steel foil may be subsequently subjected to bright annealing at a temperature of 800° C. to 1,050° C. as necessary.

The thickness of a stainless steel foil is not particularly limited, but when a stainless steel foil of the disclosed embodiments is applied to a catalyst carrier of an exhaust emission control device, a smaller thickness is more advantageous due to decreased exhaust back pressure. Stainless steel foil is easily deformed as the thickness decreases, and problems, such as breaking or folding of the stainless steel foil, result in some cases. Accordingly, the thickness of a stainless steel foil is preferably 200 μm or less and more preferably 20 to 200 m. Meanwhile, a catalyst carrier of an exhaust emission control device is required to have excellent vibration resistance and/or durability in some cases. In such cases, the thickness of a stainless steel foil is preferably set to about 100 to 200 μm. Further, a catalyst carrier of an exhaust emission control device is required to have a high cell density and/or a low back pressure in some cases. In such cases, the thickness of a stainless steel foil is more preferably set to about 20 to 100 μm.

EXAMPLES

Hereinafter, the disclosed embodiments will be described specifically in accordance with the Examples. The disclosure, however, is not intended to be limited to the following Examples.

Examples

Steels that were melted in a 50 kg small vacuum melting furnace and each had the chemical composition shown in Table 1 were heated to 1,200° C. and then hot-rolled in a temperature range of 900° C. to 1,200° C. to yield 3 mm-thick hot-rolled steel sheets. Subsequently, each hot-rolled steel sheet was subjected to: annealing under conditions in air at 900° C. for one minute; removal of surface scale through pickling with sulfuric acid, followed by pickling with a mixed solution of nitric acid and hydrofluoric acid; and subsequently, cold rolling to a thickness of 1.0 mm to yield a cold-rolled steel sheet. Then, the cold-rolled steel sheet was subjected to repeated cold rolling in a cluster mill and intermediate annealing a plurality of times to yield a stainless steel foil with a width of 100 mm and a thickness of 50 μm. Intermediate annealing was performed under conditions at 900° C. for one minute, and the surface after intermediate annealing was polished with No. 600 emery paper to remove a surface oxide layer.

The thus-obtained hot-rolled steel sheets and stainless steel foils were each evaluated for the toughness of the hot-rolled steel sheet, as well as high-temperature oxidation resistance and shape stability of the stainless steel foil.

(1) Toughness of Hot-Rolled Steel Sheet

The toughness of the hot-rolled steel sheets was evaluated by a Charpy impact test. Specimens were prepared according to the V-notch specimen of JIS standards (JIS Z 2202

(1998)). Only the thickness (width in JIS standards) was set to 3 mm without processing of the original materials. Specimens were taken such that the longitudinal direction became parallel to the rolling direction and the specimens were notched perpendicularly to the rolling direction. The tests were performed according to JIS standards (JIS Z 2242 (1998)) for three specimens at each temperature, and the absorbed energy and percent brittle fracture were measured to obtain a transition curve. A ductile-brittle transition temperature (DBTT) was set as a temperature at which a percent brittle fracture reaches 50%. The transition temperature of 75° C. or lower and that of higher than 75° C. were respectively evaluated as ○ (satisfactory) and x (unsatisfactory). It was confirmed in advance that stable cold rolling in a continuous tandem rolling mill is possible at a normal temperature when a DBTT obtained by the Charpy impact test is 75° C. or lower.

(2) High-Temperature Oxidation Resistance of Stainless Steel Foil

Each 50 μm-thick stainless steel foil was heat-treated by holding at 1,200° C. for 30 minutes (treatment corresponding to heat treatment during diffusion bonding or joining through brazing) in a vacuum of $5.3\times10^{-3}$ Pa or lower. Three specimens (20 mm width×30 mm length) were taken from the stainless steel foil after heat treatment. These specimens were oxidized through heat treatment by holding in air atmosphere at 900° C. for 400 hours, and the mass gain due to oxidation (value of a change in mass from before heating to after heating divided by an initial surface area) was measured as an average of the three specimens. In this step, no spalling of an oxide layer was observed in each specimen. The measured result of the average mass gain by oxidation was evaluated as ○ (satisfactory) for 10 g/m$^2$ or less and x (unsatisfactory) for more than 10 g/m$^2$, and ○ satisfies the object of the disclosed embodiments.

(3) High-Temperature Shape Stability of Stainless Steel Foil

Each 50 μm-thick stainless steel foil was heat-treated by holding at 1,200° C. for 30 minutes (treatment corresponding to heat treatment during diffusion bonding or joining through brazing) in a vacuum of $5.3\times10^{3}$ Pa or lower. Three specimens were each prepared by rolling up a foil (100 mm width×50 mm length) taken from the foil after heat treatment into a 5 mm-diameter cylinder in the longitudinal direction and by fixing the ends through spot welding. These specimens were oxidized through heat treatment by holding in air atmosphere at 900° C. for 400 hours, and a change in length (ratio of an increase in cylinder length after heating to a cylinder length before heating) of three specimens was measured and averaged. The measured result of the average change in length was evaluated as ○ (satisfactory) for 5% or less and x (unsatisfactory) for more than 5%, and ○ satisfies the object of the disclosed embodiments.

These results are shown in Table 2. Steel Nos. 1 to 12 and 27 to 29 of the disclosed embodiments had excellent toughness of the hot-rolled steel sheet, as well as high-temperature oxidation resistance and shape stability of the foil. Meanwhile, Steel Nos. 13 to 26 as Comparative Examples were inferior in at least one of characteristic of toughness of the hot-rolled steel sheet, high-temperature oxidation resistance, or shape stability of the foil. As the above results reveal, according to the disclosed embodiments, it becomes possible to obtain a stainless steel foil having good manufacturability, excellent oxidation resistance, and high-temperature shape stability.

TABLE 1

| | Component composition (mass %) | | | | | | | | | | | |
|---|---|---|---|---|---|---|---|---|---|---|---|---|
| Steel No. | C | Si | Mn | P | S | Cr | Al | N | Ni | Cu | Mo | Ti, Zr, Hf, REM |
| 1 | 0.008 | 0.13 | 0.11 | 0.022 | 0.001 | 11.1 | 2.8 | 0.005 | 0.15 | 0.01 | 0.06 | Ti: 0.21 |
| 2 | 0.009 | 0.15 | 0.12 | 0.025 | 0.002 | 11.0 | 3.4 | 0.009 | 0.21 | 0.03 | 0.10 | Ti: 0.26 |
| 3 | 0.008 | 0.16 | 0.11 | 0.027 | 0.002 | 14.4 | 2.7 | 0.007 | 0.18 | 0.05 | 0.04 | Ti: 0.22, Zr: 0.03, Hf: 0.02, REM: 0.02 |
| 4 | 0.011 | 0.15 | 0.17 | 0.023 | 0.001 | 10.7 | 4.3 | 0.008 | 0.19 | 0.01 | 0.02 | Ti: 0.15 |
| 5 | 0.012 | 0.22 | 0.19 | 0.022 | 0.001 | 11.6 | 3.1 | 0.008 | 0.16 | 0.05 | 0.03 | Zr: 0.03, REM: 0.05 |
| 6 | 0.008 | 0.13 | 0.15 | 0.025 | 0.002 | 11.4 | 3.3 | 0.006 | 0.14 | 0.08 | 0.01 | Zr: 0.02, REM: 0.07 |
| 7 | 0.009 | 0.15 | 0.16 | 0.026 | 0.003 | 11.2 | 3.2 | 0.007 | 0.17 | 0.03 | 0.05 | Ti: 0.11, Hf: 0.02 |
| 8 | 0.010 | 0.10 | 0.18 | 0.032 | 0.001 | 11.1 | 3.1 | 0.005 | 0.15 | 0.01 | 0.09 | Ti: 0.13 |
| 9 | 0.011 | 0.12 | 0.11 | 0.022 | 0.001 | 15.7 | 3.2 | 0.008 | 0.18 | 0.05 | 0.04 | Ti: 0.03, REM: 0.04 |
| 10 | 0.012 | 0.31 | 0.15 | 0.024 | 0.006 | 14.8 | 3.4 | 0.007 | 0.26 | 0.02 | 0.03 | Ti: 0.02, REM: 0.02 |
| 11 | 0.006 | 0.16 | 0.16 | 0.021 | 0.002 | 13.2 | 3.8 | 0.005 | 0.15 | 0.04 | 0.04 | Ti: 0.01, Zr: 0.02, Hf: 0.01, REM: 0.01 |
| 12 | 0.005 | 0.13 | 0.13 | 0.025 | 0.001 | 14.9 | 3.3 | 0.006 | 0.21 | 0.02 | 0.03 | Hf: 0.05, REM: 0.08 |
| 27 | 0.006 | 0.13 | 0.17 | 0.022 | 0.003 | 12.2 | 3.4 | 0.007 | 0.16 | 0.03 | 0.05 | Ti: 0.18 |
| 28 | 0.005 | 0.11 | 0.15 | 0.024 | 0.001 | 12.4 | 3.4 | 0.008 | 0.13 | 0.05 | 0.06 | Hf: 0.04, REM: 0.06 |
| 29 | 0.007 | 0.12 | 0.14 | 0.025 | 0.001 | 12.1 | 3.5 | 0.006 | 0.15 | 0.04 | 0.04 | Zr: 0.03, REM: 0.07 |
| 13 | 0.010 | 0.31 | 0.17 | 0.020 | 0.004 | 9.8 | 3.2 | 0.006 | 0.15 | 0.08 | 0.05 | Ti: 0.08 |
| 14 | 0.011 | 0.17 | 0.11 | 0.022 | 0.001 | 16.8 | 3.9 | 0.008 | 0.19 | 0.06 | 0.03 | Ti: 0.23 |
| 15 | 0.008 | 0.13 | 0.15 | 0.024 | 0.003 | 11.0 | 2.1 | 0.005 | 0.15 | 0.04 | 0.02 | Ti: 0.15 |
| 16 | 0.006 | 0.34 | 0.17 | 0.021 | 0.001 | 11.9 | 4.8 | 0.006 | 0.16 | 0.02 | 0.03 | Ti: 0.11, REM: 0.03 |
| 17 | 0.009 | 0.12 | 0.14 | 0.025 | 0.005 | 11.2 | 3.3 | 0.009 | 0.19 | 0.05 | — | Ti: 0.18 |
| 18 | 0.012 | 0.17 | 0.15 | 0.026 | 0.006 | 11.6 | 3.5 | 0.008 | 0.22 | 0.08 | 0.24 | Ti: 0.22, REM: 0.05 |
| 19 | 0.010 | 0.21 | 0.16 | 0.021 | 0.004 | 11.3 | 3.1 | 0.006 | 0.13 | 0.03 | 0.03 | |
| 20 | 0.012 | 0.18 | 0.13 | 0.032 | 0.003 | 11.2 | 3.3 | 0.007 | 0.15 | 0.03 | 0.04 | Ti: 0.03, Zr: 0.02 |
| 21 | 0.008 | 0.15 | 0.14 | 0.033 | 0.004 | 10.8 | 3.4 | 0.009 | 0.21 | 0.04 | 0.03 | Ti: 0.02, Hf: 0.01, REM: 0.01 |
| 22 | 0.007 | 0.18 | 0.21 | 0.024 | 0.004 | 10.9 | 3.0 | 0.006 | 0.16 | 0.02 | 0.06 | REM: 0.02 |
| 23 | 0.006 | 0.19 | 0.17 | 0.025 | 0.003 | 11.3 | 3.2 | 0.007 | 0.14 | 0.04 | 0.05 | Ti: 0.35 |
| 24 | 0.009 | 0.14 | 0.20 | 0.027 | 0.002 | 11.2 | 3.1 | 0.006 | 0.17 | 0.03 | 0.03 | Ti: 0.20, Zr: 0.11, Hf: 0.03, REM: 0.01 |
| 25 | 0.007 | 0.22 | 0.18 | 0.028 | 0.001 | 11.5 | 3.3 | 0.005 | 0.26 | 0.03 | 0.08 | Zr: 0.22 |
| 26 | 0.006 | 0.25 | 0.20 | 0.025 | 0.002 | 11.1 | 3.2 | 0.007 | 0.19 | 0.03 | 0.04 | Hf: 0.28 |

TABLE 1-continued

| Steel No. | Component composition (mass %) Others | Ti + Zr + Hf + 2REM | Ti + Zr + Hf | Note |
|---|---|---|---|---|
| 1 | | 0.21 | 0.21 | Example |
| 2 | | 0.26 | 0.26 | Example |
| 3 | | 0.31 | 0.27 | Example |
| 4 | | 0.15 | 0.15 | Example |
| 5 | Nb: 0.05 | 0.13 | 0.03 | Example |
| 6 | | 0.16 | 0.02 | Example |
| 7 | V: 0.02 | 0.13 | 0.13 | Example |
| 8 | B: 0.0009 | 0.13 | 0.13 | Example |
| 9 | Mg: 0.0044 | 0.11 | 0.03 | Example |
| 10 | Ca: 0.0037 | 0.06 | 0.02 | Example |
| 11 | | 0.06 | 0.04 | Example |
| 12 | V: 0.03, Ca: 0.0029, Mg: 0.0032 | 0.21 | 0.05 | Example |
| 27 | | 0.18 | 0.18 | Example |
| 28 | Nb: 0.06, B: 0.0005 | 0.16 | 0.04 | Example |
| 29 | V: 0.02, Ca: 0.0017, Mg: 0.0021 | 0.17 | 0.03 | Example |
| 13 | | 0.08 | 0.08 | Comparative Example |
| 14 | | 0.23 | 0.23 | Comparative Example |
| 15 | | 0.15 | 0.15 | Comparative Example |
| 16 | | 0.17 | 0.11 | Comparative Example |
| 17 | | 0.18 | 0.18 | Comparative Example |
| 18 | | 0.32 | 0.22 | Comparative Example |
| 19 | | 0.00 | 0.00 | Comparative Example |
| 20 | | 0.05 | 0.05 | Comparative Example |
| 21 | | 0.05 | 0.03 | Comparative Example |
| 22 | | 0.04 | 0.00 | Comparative Example |
| 23 | | 0.35 | 0.35 | Comparative Example |
| 24 | | 0.36 | 0.34 | Comparative Example |
| 25 | | 0.22 | 0.22 | Comparative Example |
| 26 | | 0.28 | 0.28 | Comparative Example |

Note:
underlined parts represent being outside the range of the disclosed embodiments.

TABLE 2

| Steel No. | Toughness of hot-rolled steel sheet (3 mm thick) Evaluation of DBTT | High-temperature oxidation resistance Evaluation of mass gain due to oxidation | High-temperature shape stability Evaluation of shape changes | Note |
|---|---|---|---|---|
| 1 | ○ | ○ | ○ | Example |
| 2 | ○ | ○ | ○ | Example |
| 3 | ○ | ○ | ○ | Example |
| 4 | ○ | ○ | ○ | Example |
| 5 | ○ | ○ | ○ | Example |
| 6 | ○ | ○ | ○ | Example |
| 7 | ○ | ○ | ○ | Example |
| 8 | ○ | ○ | ○ | Example |
| 9 | ○ | ○ | ○ | Example |
| 10 | ○ | ○ | ○ | Example |
| 11 | ○ | ○ | ○ | Example |
| 12 | ○ | ○ | ○ | Example |
| 27 | ○ | ○ | ○ | Example |
| 28 | ○ | ○ | ○ | Example |
| 29 | ○ | ○ | ○ | Example |
| 13 | ○ | x | x | Comparative Example |
| 14 | x | ○ | ○ | Comparative Example |
| 15 | ○ | x | x | Comparative Example |
| 16 | x | ○ | ○ | Comparative Example |
| 17 | ○ | ○ | x | Comparative Example |
| 18 | x | ○ | ○ | Comparative Example |
| 19 | ○ | x | x | Comparative Example |

TABLE 2-continued

| Steel No. | Toughness of hot-rolled steel sheet (3 mm thick) Evaluation of DBTT | High-temperature oxidation resistance Evaluation of mass gain due to oxidation | High-temperature shape stability Evaluation of shape changes | Note |
|---|---|---|---|---|
| 20 | ○ | ○ | x | Comparative Example |
| 21 | ○ | ○ | x | Comparative Example |
| 22 | ○ | ○ | x | Comparative Example |
| 23 | ○ | ○ | x | Comparative Example |
| 24 | ○ | ○ | x | Comparative Example |
| 25 | ○ | x | x | Comparative Example |
| 26 | ○ | x | x | Comparative Example |

The invention claimed is:

1. A stainless steel sheet having a chemical composition comprising, by mass %:

C: 0.015% or less;
Si: 0.50% or less;
Mn: 0.50% or less;
P: 0.040% or less;
S: 0.010% or less;
Cr: 10.0% to 14.0%;
Al: 2.5 to 4.5%;
N: 0.015% or less;
Ni: 0.05 to 0.50%;
Cu: 0.01 to 0.10%;

Mo: 0.01 to 0.15%;

at least one selected from the group consisting of Ti: 0.01 to 0.30%, Zr: 0.01 to 0.20%, Hf: 0.01 to 0.20%, and REM: 0.01 to 0.20%; and the balance being iron and incidental impurities, wherein the following Expression (1) and Expression (2) are satisfied:

$$Ti+Zr+Hf+2REM \geq 0.06 \quad (1)$$

$$0.30 \geq Ti+Zr+Hf \quad (2)$$

where Ti, Zr, Hf, and REM each represent the content, by mass %, of each respective element and are zero if not contained.

2. The stainless steel sheet according to claim 1, wherein the chemical composition further comprises, by mass %, at least one selected from the group consisting of Nb: 0.01 to 0.10%, V: 0.01 to 0.50%, B: 0.0003 to 0.0100%, Ca: 0.0002 to 0.0100%, and Mg: 0.0002 to 0.0100%.

3. A stainless steel foil comprising the steel sheet according to claim 1, wherein the stainless steel foil has a thickness of 200 μm or less.

4. The stainless steel foil according to claim 3, wherein the stainless steel foil is configured to be a catalyst carrier of an exhaust emission control device.

5. A stainless steel foil having comprising the steel sheet according to claim 2, wherein the stainless steel foil has a thickness of 200 μm or less.

6. The stainless steel foil according to claim 5, wherein the stainless steel foil is configured to be a catalyst carrier of an exhaust emission control device.

* * * * *